US006758945B1

(12) United States Patent
Haik

(10) Patent No.: US 6,758,945 B1
(45) Date of Patent: Jul. 6, 2004

(54) METHOD AND APPARATUS FOR QUENCHING THE COKE DRUM VAPOR LINE IN A COKER

(75) Inventor: Stephen Michel Haik, Slidell, LA (US)

(73) Assignee: Shell Oil Company, Houston, TX (US)

( * ) Notice: Subject to any disclaimer, the term of this patent is extended or adjusted under 35 U.S.C. 154(b) by 854 days.

(21) Appl. No.: 09/661,979

(22) Filed: Sep. 14, 2000

(51) Int. Cl.[7] ..... C10G 9/14; C10B 39/00

(52) U.S. Cl. ..... 202/227; 700/270; 700/282; 201/1; 201/30; 208/48 R; 208/48 Q; 208/131; 208/DIG. 1; 203/1; 203/2

(58) Field of Search ..... 700/270, 282; 201/1, 30; 208/48 R, 48 Q, 131, DIG. 1; 203/1, 2; 202/227

(56) References Cited

U.S. PATENT DOCUMENTS

| | | | | |
|---|---|---|---|---|
| 3,917,564 A | | 11/1975 | Meyers | 208/131 |
| 4,166,770 A | * | 9/1979 | Anderson et al. | 203/2 |
| 4,549,934 A | * | 10/1985 | Graf et al. | 196/98 |
| 4,578,152 A | * | 3/1986 | Albers | 203/1 |
| 4,797,197 A | * | 1/1989 | Mallari | 208/131 |
| 4,874,505 A | | 10/1989 | Bartilucci et al. | 208/131 |
| 5,009,767 A | | 4/1991 | Bartilucci et al. | 208/85 |
| 5,068,024 A | * | 11/1991 | Moretta et al. | 208/13 |
| 5,132,918 A | * | 7/1992 | Funk | 700/270 |
| 5,258,115 A | * | 11/1993 | Heck et al. | 208/131 |
| 5,389,234 A | * | 2/1995 | Bhargava et al. | 208/131 |
| 5,795,445 A | | 8/1998 | Boswell et al. | 201/39 |
| 5,824,194 A | * | 10/1998 | Kruse | 201/29 |

FOREIGN PATENT DOCUMENTS

| | | |
|---|---|---|
| CA | 2006108 | 7/1990 |
| WO | 98/30301 | 7/1998 |

OTHER PUBLICATIONS

Advanced Control and Information Systems '99: "Delayed Coker" Hydrocarbon Proc., vol. 78, No. 9, Sep. '99, pp. 107.

R. Jaisinghani et al, "Delayed Coker Fractionator Advanced Control" Hydrocarbon Proc., vol. 72, No. 8, Aug. '93, pp. 173–178.

* cited by examiner

*Primary Examiner*—Glenn Caldarola
*Assistant Examiner*—Alexis Wachtel

(57) ABSTRACT

A method and apparatus for quenching the coke drum vapor line from a coke drum to the main fractionator in a coker unit whereby the volume of quench liquid prevents the drum vapor line from plugging with carbon-based deposits. A differential pressure control technique is utilized to quench the drum vapors being delivered to the fractionator as opposed to a temperature, delta temperature, uninsulated vapor line, or fixed flow rate control as used in the prior art. Vapor line quench control by differential pressure prevents over-quenching of the vapor line during a coke drum switch, unit startup, or slowdown as well as under-quenching during drum warm-ups. It improves the fractionator recovery time from a drum switch and overall liquid product yield during the drum cycle which can be produced by over-quenching. It also prevents the vapor line from drying out at anytime, an under-quenched condition, as long as the quench oil quality and conditions do not vary significantly.

3 Claims, 2 Drawing Sheets

METHOD AND APPARATUS FOR QUENCHING THE COKE DRUM VAPOR LINE IN A COKER

BACKGROUND OF THE INVENTION

1. Field of the Invention

The invention is related to coker units and their operation, particularly in the quenching of the vapor line running from coke drums to a fractionator in a coker unit.

2. Description of Related Art

Flow rate in a coke drum vapor line is influenced by several factors including quench injection rate, quench oil properties, coke drum temperature, vapor rate and pressure drop from the coke drums to the fractionator. In prior systems, the actual rate of liquid flowing out of the vapor line into the coker main fractionator varies during the coking cycle and can go to zero liquid flow, a dry vapor line condition which can eventually lead to plugging of the vapor line. Prior systems result in either of two undesirable conditions: (1) overquench, which reduces yields and possibly reduces unit feed rates, OR (2) underquench, which leaves a vapor line without any liquid to flush the line out into the main fractionator and which will eventually shut down the coker as the vapor line cokes. Once the line cokes to the point of causing enough pressure drop from the coke drums to the main fractionator such that all the liquid evaporates, only a short time remains until the coker must be shut down—a very expensive event. In the prior systems, the quench cannot generally be adjusted to target its contribution to the recycle ratio. One prior method, the delta temperature control technique, could possibly target a contribution of the recycle ratio; however, the downstream temperature indicator (TI) must be located in the common part of the vapor line near the fractionator in order for this to work correctly. The problem with putting a TI in this location is that, in all likelihood, it will foul and become inaccurate. As described in the present disclosure, a TI located at the coke drum vapor line outlet into the fractionator is not accessible during operation but is easily cleaned while decoking a drum. Prior quench techniques do not consider pressure differential between the coke drum and the fractionator.

SUMMARY OF THE INVENTION

The invention is a method and apparatus for quenching the coke drum vapor line which runs from the coke drum to the main fractionator in a coker unit. The unique part of this improved quench system is that it uses both pressure differential and unit feed rates to control quench rates for a given quench oil and unit feed quality. If the composition of the coker feed or the quench oil changes significantly, a new set of quench curves should be generated to ensure proper quenching of the coke drum vapor line. The purpose of quench is to prevent the drum vapor line from plugging with carbon-based deposits. Plugging of the vapor line causes a restriction in coker unit feed rates and ultimately leads to severely limiting coker feed rates until the plug is removed. In order to remove the vapor line plug, shut down of the unit is required which results in lost coker capacity, due to the gradual slowdown and subsequent shutdown of the coker unit, and in significant economic loss. A differential pressure control technique is utilized to quench the drum vapors going to the fractionator as opposed to a temperature, delta temperature, uninsulated line or fixed flow rate control technique as used in prior systems. Vapor line quench control by differential pressure prevents over-quenching of the vapor line during a coke drum switch, unit startup, or slowdown as well as preventing under-quenching during drum warm-ups. It improves the fractionator recovery time after a drum switch and the overall liquid product yield during the drum cycle which can be reduced by over-quenching. It also prevents the vapor line from drying out at anytime, an under-quenched condition, as long as the quench oil quality and conditions do not vary significantly.

DESCRIPTION OF PREFERRED EMBODIMENTS

Figure 1:
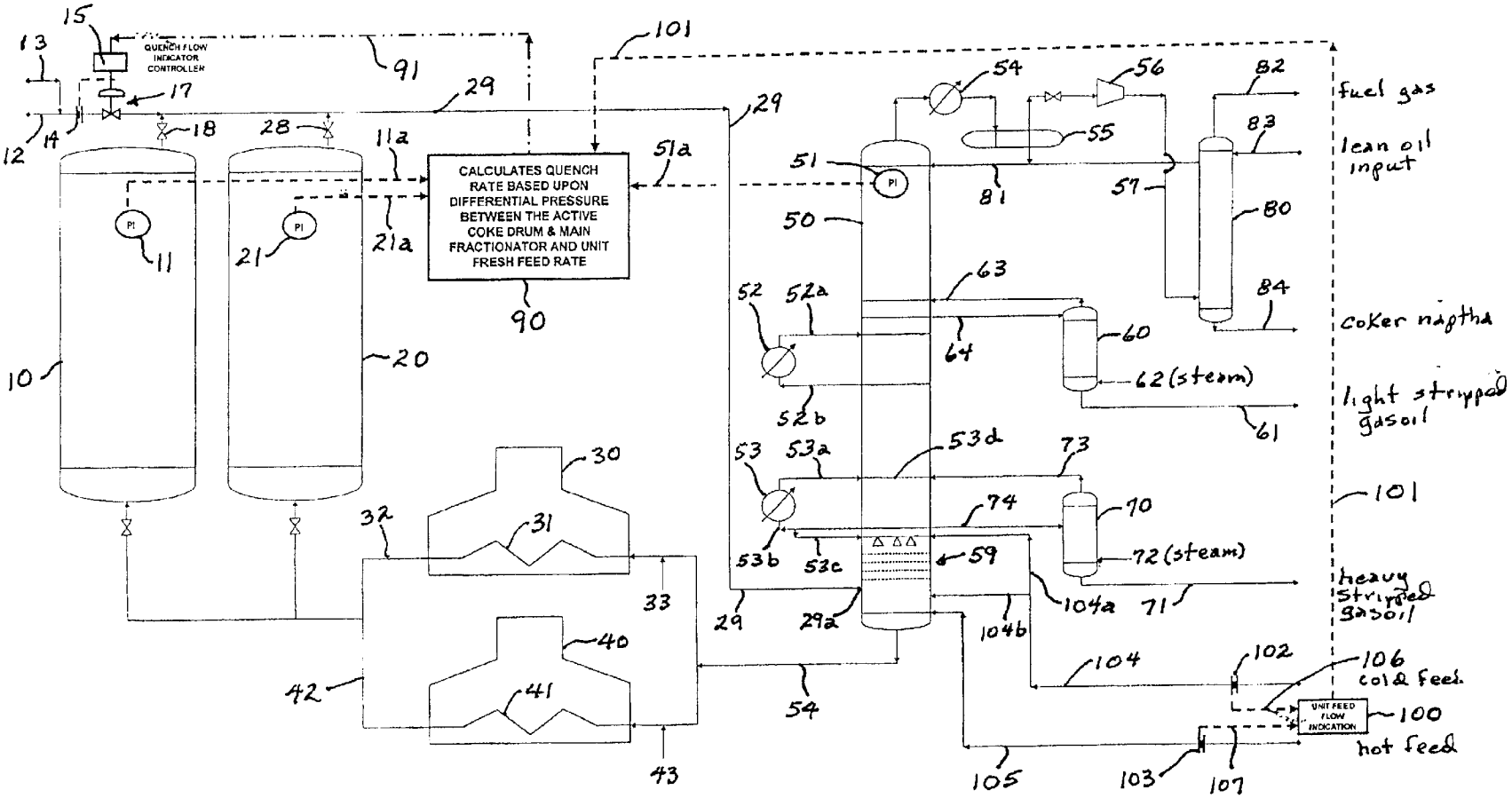
FIG. 1 is a schematic drawing of a coker unit which incorporates the instant invention.

The root cause of a coker vapor line plug is drying out of the vapor line. In particular, during coke drum warm-up, the vapor line may dry out due to the increased pressure drop from the coke drum to the fractionator if there is no increase in quench rate to prevent drying. This added pressure drop can cause all of the liquid to flash off inside the vapor line which leaves a layer of carbon residue with entrained coke fines. To reduce the risk of plugging the vapor line, the quench technique disclosed herein adjusts quench rates based upon pressure drop and unit feed rate. This delta pressure quench control technique greatly reduces the potential of the vapor line drying out and maintains a constant flow of liquid flowing out the end of the vapor line into the fractionator. It will generally increase yields vis-a-vis the prior art delta temperature quench control (if the vapor line temperature indicator (TI) is not located near the fractionator), or the constant vapor temperature quench flow technique, at a much reduced risk of plugging the vapor line. These latter two prior art techniques rely on over-quenching for most of the drum cycle in order to prevent drying of the vapor line during drum warm-up. Or, if the temperature indicator (TI) is placed in an inaccessible portion of the vapor line, the TI can foul with coke and produce unreliable data, resulting in under-quenching. If the delta temperature quench control technique is to be reliable, accurate vapor line temperatures near the coker main fractionator are necessary; however, temperature indication in this portion of the vapor line is inherently unreliable since it is in this common portion of the vapor line where the vapor line will Likely foul, producing unreliable temperature data. The fixed-quench rate vapor temperature control may result in under-quenching and a dry vapor line whenever a drum switch occurs, and this can lead to the formation of a plugged vapor line.

The present invention overcomes three limitations of the quenched vapor temperature control technique used in prior systems: (1) the possibility of drying out the coke drum vapor line; (2) the inferior reliability of temperature indication in a coking environment to control the quench rate, and (3) the essential over-quenching necessary during most of the drum cycle if adequate quench is to be supplied during drum warm-up, when the pressure drop is usually at its highest. Also, the accuracy of the drum pressure indicator is easily verified during every drum cycle because the inactive drum is opened to the atmosphere, therefore the pressure indicator will read zero psig if working properly. However, the temperature transducer can certainly foul with coke, such that its accuracy is not easily verified between drum cycles, due to the metal not having time to cool to ambient verifiable conditions between cycles. Or if the TI is located in the common portion of the vapor line, one will not know if the TI is fouled, thus producing unreliable data to control quench rates.

In the following discussion, two coke drums are illustrated and described. It will be appreciated that a coker unit may comprise more than two coke drums. Referring now to FIG. 1, a typical coker unit comprises two coke drums 10 and 20, two coker furnaces 30 and 40, a main fractionator 50, a light gasoil stripper 60, a heavy gasoil stripper 70 and possibly a rectified absorber 80, all of which are known to those skilled in the art. In the instant invention, a computer controller 90 is additionally required to receive input data from the coke drums 10, 20, the fractionator 50 and the input feed rate indicator 100 and to generate control signals for controlling quench flow rate as will be subsequently described. Each of the coke drums 10, 20 contain pressure transducers 11, 21, respectively, which monitor the pressure inside the respective drums at all times and relay such data to the controller 90. It will be appreciated that, at any given time, one of the coke drums will be "active" (on-line) and the other will be off-line undergoing decoking and cleaning in preparation for the next cycle, as is well known to those skilled in the art. Likewise, the main fractionator 50 also includes a pressure transducer 51 for constantly monitoring the pressure therein and relaying such data to controller 90.

In operation, a cold feed heavy oil such as 6-Oil at about 180° F. is fed through flow meter 102 and line 104 to fractionator 50, via line 104*a* to grid tray/spray unit 59 or via line 104*b* to the bottom of the fractionator 50. Concurrently, a hot feed, such as hot pitch at about 500° F., is fed through flow meter 103 and line 105 into the bottom of fractionator 50. Flow meter signals from flow meters 102, 103 are relayed through data lines 106, 107 respectively to the unit feed flow indicator 100. The resulting flow signal is relayed over data line 101 to the controller 90. The hot fractionator bottom stream is fed through line 54 to furnaces 30, 40, after injecting velocity steam at 33, 43, respectively, where it is circulated through tubes 31, 41, respectively, and heated up to about 910° F. The bottoms must be severely thermally cracked, otherwise it will not coke, and will, instead, form tar. The hot fractionator bottoms exit the furnace tubes 31, 41 at 32, 42, respectively, at about 910° F. and are directed to the active coke drum, either 10 or 20. In the usual manner, the active coke drum 10 or 20 catches and retains carbon matter while hydrocarbons evaporate. It will be appreciated that this described apparatus is called a "delayed coker" since it requires a combination of residence time and temperature to form coke in the coke drums 10, 20. Pressure transducers 11 and 21 relay data over lines 11*a* and 21*a* respectively to the controller 90. Vapor from the active coke drum 10 or 20 is passed through one of the valves 18, 28 to the overhead coke drum vapor line 29. A quench liquid is also injected into vapor line 29 through inputs 12 or 13, flow meter 14 and valve 17 to form a mixture of quench oil and vapor in vapor line 29. Quench liquid 12 may be slop oil while quench liquid 13 may be a coker gasoil. Quench liquid flow rate through vapor line 29 is set by the quench flow indicator controller 15 which regulates valve 17 in response to a signal received from the controller 90 over control line 91 as will be subsequently explained.

The quench oil/vapor mixture in vapor line 29 is injected at the bottom of fractionator 50 at 29*a*, where, in prior systems, a thermocouple may have been placed to detect and relay temperature data and to possibly be used for controlling the flow rate. As has been explained, this temperature tended to be unreliable since the thermocouple became coated with coke and became inaccurate. Main fractionator 50 includes a heavy gasoil pump-around exchanger 53 for cooling vapors and removing heat from the system. A circulation reflux unit also includes a pump-around exchanger 52 for cooling vapors and removing heat from the system further up the column 50. Exchanger 52 receives hot circulating reflux oil through line 52*b* and sends cooled circulating reflux oil back to fractionator 50 through line 52*a*. Exchanger 53 receives hot unstripped heavy gasoil through line 53*b*, and part of the hot heavy gasoil can possibly go back to the spray 59 through line 53*c* to prevent entrained coke fines from escaping into the overhead vapors. Cooled heavy gasoil from exchanger 53 is sent back to the fractionator 50 via line 53*a* where it is flowed onto tray 53*d* as part of the pumparound heat removal system. Heavy gasoil stripper 70 receives unstripped heavy gasoil from the fractionator 50 through line 74 and steam is injected through line 72 to form stripped heavy gasoil which is withdrawn by line 71. Steam and stripped-out heavy gasoil is recirculated to the fractionator 50 via line 73 where it flows onto tray 53*d*. Line 53*c* is an alternate source of liquid for spray 59 which, if used, reroutes the cold feed flowing in line 104 to the bottom of the fractionator 50 via line 104*b* along with the hot pitch through line 105. Spray unit/contacting trays 59 prevent entrained coke fines from escaping into the overhead vapors.

Light gasoil stripper 60 may be used for receiving light unstripped gasoil through line 64 and steam through line 62. Light stripped gasoil is produced and is withdrawn through line 61 while the remaining vapors are sent back to the fractionator 50 through line 63. The overhead vapors in fractionator 50 are passed on to the overhead condenser 54 which removes heat from the overhead vapors. The condensed liquid passes to an accumulator 55 and wet gas compressor 56 compresses the wet gasses, such as methane, ethane, propane, and butane. The output of wet gas compressor 56 is transported through line 57 to the rectified absorber (RA) 80 where fuel gas is withdrawn at 82 and coker naphtha at 84, the latter being sent to a hydrotreating unit. The absorber 80 receives a lean oil input 83 which assists in the separation of ethane from propane. Line 81 contains the overhead liquid hydrocarbons that have been condensed in the overhead condenser 54. These liquids are either sent back to the main fractionator 50 as reflux or to the 80. Pressure transducer 51 continuously transmits the pressure inside fractionator 50 to the controller 90 over line 51*a*.

As noted, the controller 90 receives continuous pressure signals from pressure transducers 11, 21 in coke drums 10, 20, respectively, and from pressure transducer 51 in fractionator 50, even from the off-line drum being decoked. The 16 controller 90 also receives an input feed rate signal 101 (in barrels per day) from unit feed flow indicator 100. Controller 90 senses which of the drums 10, 20 is active (on-line), since the pressure in the off-line drum is lower than the pressure in the on-line drum. It then calculates the difference in pressure (DP) between the active drum (10 or 20) and the fractionator 50 pressure transmitted by pressure transducer 51. This DP is used by the controller 90, along with the feed flow rate 101, to calculate the quench flow rate which is required to be injected at 12, 13 in order to maintain a selected fresh feed liquid flow percentage of, say 5 vol %, in vapor line 29 at point 29*a* where the vaporline 29 intersects the main fractionator 50. This is a very important area of the vapor line to understand. If one does not understand what influences the amount of liquid in the vapor line at this point, one could potentially (1) overquench, i.e., too much liquid, which reduces liquid yields and increases coker unit recycle to the main fractionator bottoms and potentially could reduce coker unit throughput OR (2) underquench, i.e., too little liquid, resulting in a dry, non-irrigated, vapor line which will foul with coke and eventually shut down the coker unit. Either one of these conditions is. undesirable. A signal is sent over line 91 to the quench flow indicator controller 15 and valve 17 is automatically adjusted to maintain such selected flow rate.

Quench rates needed to maintain a wetted line at various vapor line pressure differentials, and unit feed rates required to ensure a constant liquid rate flowing out of the lo vapor line 29 into the coker main fractionator 50 were calculated. A PRO/II® general purpose process and optimization software by Simulation Sciences, Inc. was used to generate the data. This data is presented in Tables 1 and 2 below.

Tables 1 & 2 were obtained via computer simulation of the coke drum vapor line thermodynamics. Based upon the measured coker feed product yields and quench liquid properties, a simulation was run to determine the quench rate needed to produce a constant percentage of unit recycle from liquid flowing out of the coke drum vapor line into the bottom of the main fractionator. The vapor line pressure drop was varied to determine the quench rate needed to maintain constant liquid flow into the main fractionator, while at premeasured product yields and quench oil properties.

Figure 2:
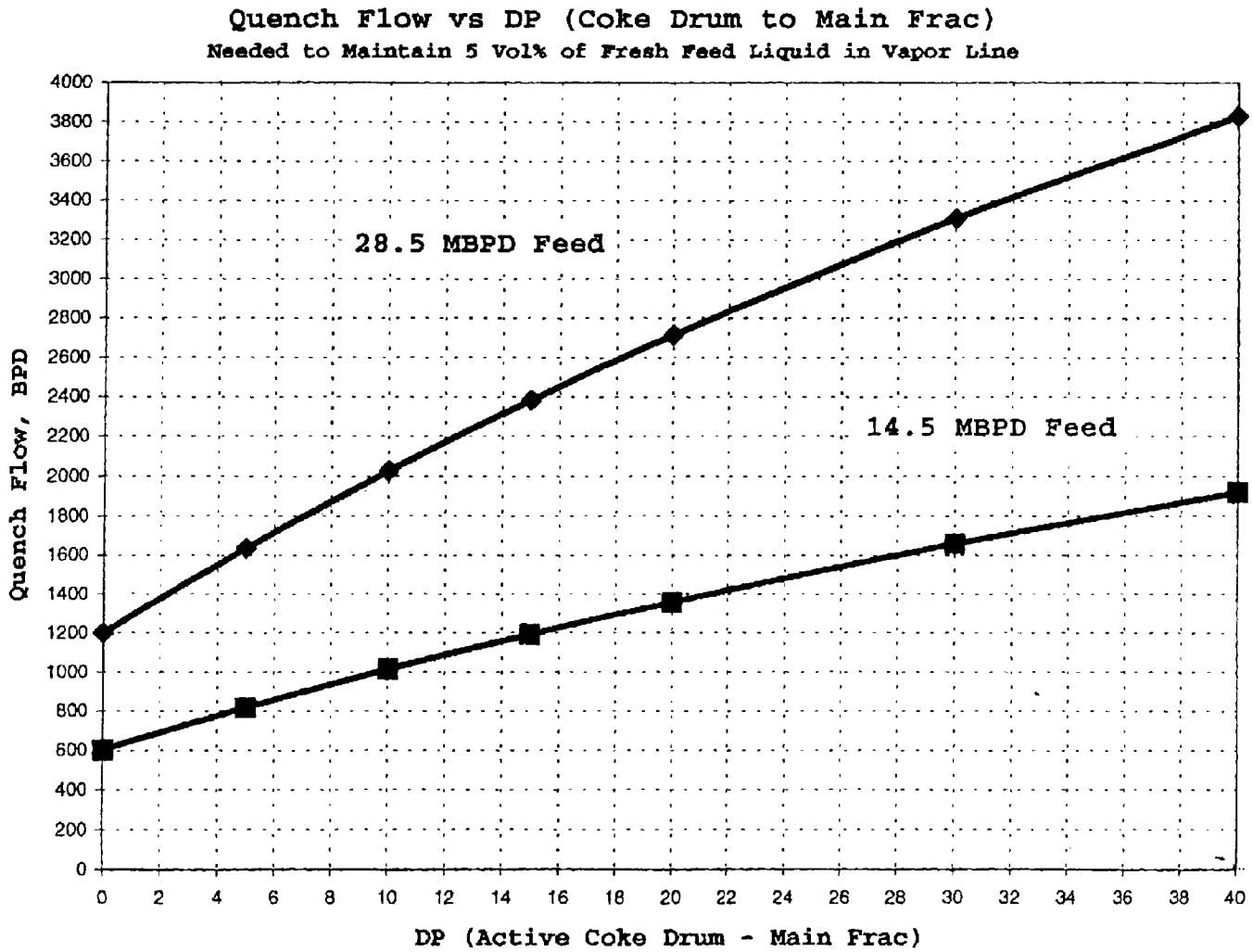
FIG. 2 is a graph showing quench flow vs. pressure differential for the minimum and maximum feed rates for a typical coker unit and coker feed quality.

From Tables 1 & 2, the curves shown in FIG. 2 were produced. Differential pressure drop (psi) from the active coke drum to the main fractionator is used as the X axis and quench rate (bpd) as the Y axis. Once the curves are prepared for a particular coker, (for a given set of unit yields and quench oil properties) such information is used to control quench flows via computer control thereafter.

TABLE 1

Quench Flow Calculation for 5 Vol % Recycle based on 28,500 bpd Fresh Feed Rate

| DP - Differential Pressure, psi | Quench Flow BPD | Drips (Liquid Flowing out of) - Vapor Line into Main Frac - BPD | Quench Temperature at Main Frac - ° F. | Drum Pressure Psig |
|---|---|---|---|---|
| 0 | 1200 | 1425 | 811 | 25 |
| 5 | 1633 | 1425 | 811 | 30 |
| 10 | 2025 | 1425 | 811 | 35 |
| 15 | 2383 | 1425 | 811 | 40 |
| 20 | 2714 | 1425 | 811 | 45 |
| 30 | 3307 | 1425 | 811 | 55 |
| 40 | 3831 | 1425 | 811 | 65 |

TABLE 2

Quench Flow Calculation for 5 Vol % Recycle based on 14,500 bpd Fresh Feed Rate

| DP - Differential Pressure, psi | Quench Flow BPD | Drips (Liquid Flowing out of) - Vapor Line into Main Frac - BPD | Quench Temperature at Main Frac - ° F. | Drum Pressure Psig |
|---|---|---|---|---|
| 0 | 602 | 725 | 810 | 25 |
| 5 | 818 | 725 | 810 | 30 |
| 10 | 1014 | 725 | 810 | 35 |
| 15 | 1193 | 725 | 810 | 40 |
| 20 | 1356 | 725 | 810 | 45 |
| 30 | 1656 | 725 | 810 | 55 |
| 40 | 1918 | 725 | 810 | 65 |

Note: Quench Oil temperature is assumed to be 100–150° F. and of a light gasoil boiling range hydrocarbon. If the available quench oil is significantly different, another set of tables may need to be produced.

Referring now to FIG. 2, Tables 1 and 2 have been displayed in graph form for the maximum (28.5 MBPD) and minimum (14.5 MBPD) feed rates for a typical coker unit.

What is claimed is:

1. A delayed coker comprising:

an active coke drum having a pressure transducer for measuring the pressure within said drum, said coke drum being adapted to receive hot fractionator bottoms from a fractionator, to capture the carbon from said bottoms and to pass vapors from said bottoms to a vapor line;

means for injecting a quench liquid into said vapor line;

a fractionator, adapted to receive said vapors from said vapor line, to receive a hydrocarbon feed material thereinto and having means for measuring the pressure therein;

a controller for receiving pressure signals from said coke drum and said fractionator and for calculating the pressure differential therebetween;

means for generating a signal representing the feed rate supplied to said fractionator and supplying said signal to said controller; and means within said controller for evaluating said pressure differential and said feed flow input rate data and generating, in response thereto, a signal for controlling a selected amount of quench liquid to be injected into said vapor line.

2. The apparatus of claim 1 further including at least one additional coke drum in parallel with said active coke drum.

3. In a delayed coker unit having a coke drum and a fractionator connected by a vapor line, a method for measuring and controlling the amount of flow of quench liquid injected into said vapor line, comprising the steps of:

measuring the pressure within said coke drum;

measuring the pressure within said fractionator;

measuring the total flow rate of a liquid feed supplied to said fractionator;

supplying, to a controller, said measured pressures and said measured total flow rate of feed liquid being supplied to said fractionator;

using coke drum vapor line thermodynamics to evaluate the relationship between said pressure differential and said feed flow input rate data;

determining, from said relationship, the amount of quench liquid which must be supplied to said vapor line in order to maintain a desired flow rate of liquid through said vapor line and into said fractionator;

generating, in response to said relationship, a signal for controlling a selected amount of quench liquid which must be injected into said vapor line in order to result in the desired flow rate of liquid through said vapor line and into said fractionator; and controlling the flow rate of quench liquid injected in said vapor line by supplying said generated signal to a supply valve for opening and closing said valve in response to said generated signal.

* * * * *